United States Patent [19]

Grossman

[11] 4,059,119

[45] Nov. 22, 1977

[54] CIGARETTE AND FILTER

[75] Inventor: Harold Grossman, Upper Montclair, N.J.

[73] Assignee: Montclair Research Corporation, Silver Spring, Md.

[21] Appl. No.: 687,110

[22] Filed: May 17, 1976

Related U.S. Application Data

[63] Continuation of Ser. No. 479,104, June 13, 1974, abandoned.

[51] Int. Cl.[2] ..... A24B 15/00; A24B 15/02; A24B 15/027

[52] U.S. Cl. ..... 131/9; 131/10 R; 131/17 R

[58] Field of Search ..... 131/9, 10 R, 10 A, 10.1, 131/10.3, 10.5, 10.7, 10.9, 11, 12, 17 R, 17 A, 140 R, 140 C, 261 R, 261 A, 262 R, 262 A, 264

[56] References Cited

U.S. PATENT DOCUMENTS

| | | | |
|---|---|---|---|
| 2,768,913 | 10/1956 | Hiler | 131/265 X |
| 3,087,500 | 4/1963 | Jacobson | 131/261 B X |

FOREIGN PATENT DOCUMENTS

| | | | |
|---|---|---|---|
| 752,358 | 2/1954 | United Kingdom | 131/266 |
| 654,994 | 7/1951 | United Kingdom | 131/10.9 |

*Primary Examiner*—Robert W. Michell
*Assistant Examiner*—V. Miller
*Attorney, Agent, or Firm*—Shapiro and Shapiro

[57] ABSTRACT

A filter for tobacco smoke employs synthetic, inorganic, water-insoluble, anhydrous fibers having a positive zeta potential at the pH of tobacco smoke.

To increase the effectiveness of the filter, the tobacco associated with the filter has mixed therewith and deposited thereon particles of a water-insoluble, hydrophobic, moisture-laden, negative charge-imparting substance.

24 Claims, 1 Drawing Figure

CIGARETTE AND FILTER

This is a continuation of application Ser. No. 479,104, filed June 13, 1974 now abandoned.

The invention relates to improvements in filters for tobacco smoke, and to the combination of a body of divided tobacco which is treated to make the filter associated with the tobacco more effective.

BACKGROUND OF THE INVENTION

Cigarette filters now in commercial use are only partially effective; they remove approximately 30% of the tars and nicotine. The approximately 70% that passes the filter obviously is not trapped by the filter material. The reason is that these substances are in the form of fine particles which are colloidally dispersed, and because of their small size pass through the usual or known filters with the gases in which they are dispersed.

Tobacco smoke is a two-phase system: a vapor phase and a dispersed particulate phase. The vapor phase may be considered the fraction which is volatile above 86° F., which is smoking temperature, and some high boiling point components not immediately condensed. The smoke consists of approximately 4–9% particulate matter or particles dispersed in the 91–96% vapor phase components. The vapor phase components consist of nitrogen, oxygen, carbon monoxide gases and other materials which are in the gaseous state above 86° F. During the smoking process, pyrosynthesis, pyrolysis, and distillation take place, and it has been estimated that there are as many as 700–800 resulting compounds. Straight chain hydrocarbons predominate.

When a cigarette is being smoked, the particulates which are generated have Brownian movement within the gaseous vapor phase. Observations with a dark field condenser, dialysis, electrophoresis, and Tyndal studies indicated that many particulates in the smoke are negatively charged and have lively Brownian motion. It has been estimated that there are approximately $2 \times 10^9$ negatively charged particles per millimeter in tobacco smoke.

Also, one of the serious problems in the filtration of tobacco smoke is the hydrophobic character of the carcinogenic tars, which are oleophilic.

SUMMARY OF THE INVENTION

In accordance with the invention, a filter for tobacco smoke is provided which acts to attract the negatively charged particles dispersed in tobacco smoke. The filter is made of synthetic, inorganic, water-insoluble, anhydrous fibers which have a positive zeta potential at the pH of tobacco. The fibers may be hydrophobic or hydrophilic.

Based upon tests and observations, filters made in accordance with the invention act to cause coalescence of the colloidally dispersed negative particles in the smoke to enlarge them and render them more easily filterable. By coalescing the particles to shift the size distribution to the larger portion of the size-distribution curve, much more effective filtration is accomplished. As the size of the coalesced particles increases, the mass becomes larger thereby decreasing the number of particles in the smoke. Increasing the mass, increases the probability of the particles contacting the absorber surface of the filter. As the diameter of the coalesced mass of particles increases, the distance from the particle to the absorbing surface provided by the individual fibers becomes shorter. The universal gravitational attraction increases; also, the electrostatic forces between the larger coalesced particles and the fibers are increased. Since removal of particulates in smoke depends on probability of collision or contact with the fiber absorber surfaces, the probabilities are increased with increased particle size. This is essentially a physical phenomenon. The velocity of flow of the larger particles is slower than that of the smaller particles. Increased mass decreases the velocity of the particles in the gas flow. The larger the mass, the greater the initial impaction which is a major influence in filter efficiency. Thus, by causing the colloidally dispersed negative particles in the smoke to be coalesced into clumps of increased size and mass, marked improvement in filter efficiency is attained.

To increase the efficiency of the filter, the positive charge or the positive zeta potential on the fibers may be increased by coating the fibers with a secondary source of positive zeta potential. This boosting or enhancement of the positive zeta potential is accomplished by adding to the fibers a positive colloidal metal oxide or a metal oxide having more than one positive ion.

In order to substantially increase the effectiveness of the filter, the tobacco with which the filter is associated is treated so that in the burning the resulting smoke will contain more particulates which are negatively charged, also more strongly negatively charged, in addition to the particulates which normally are negatively charged. For this purpose, the tobacco has deposited thereon particles of a water-insoluble, hydrophobic, moisture-laden, negative charge-imparting substance.

These, and other objects and advantages of the invention will be apparent from the following detailed description, taken in conjunction with the drawing.

DESCRIPTION OF THE PREFERRED EMBODIMENT

Figure 1:
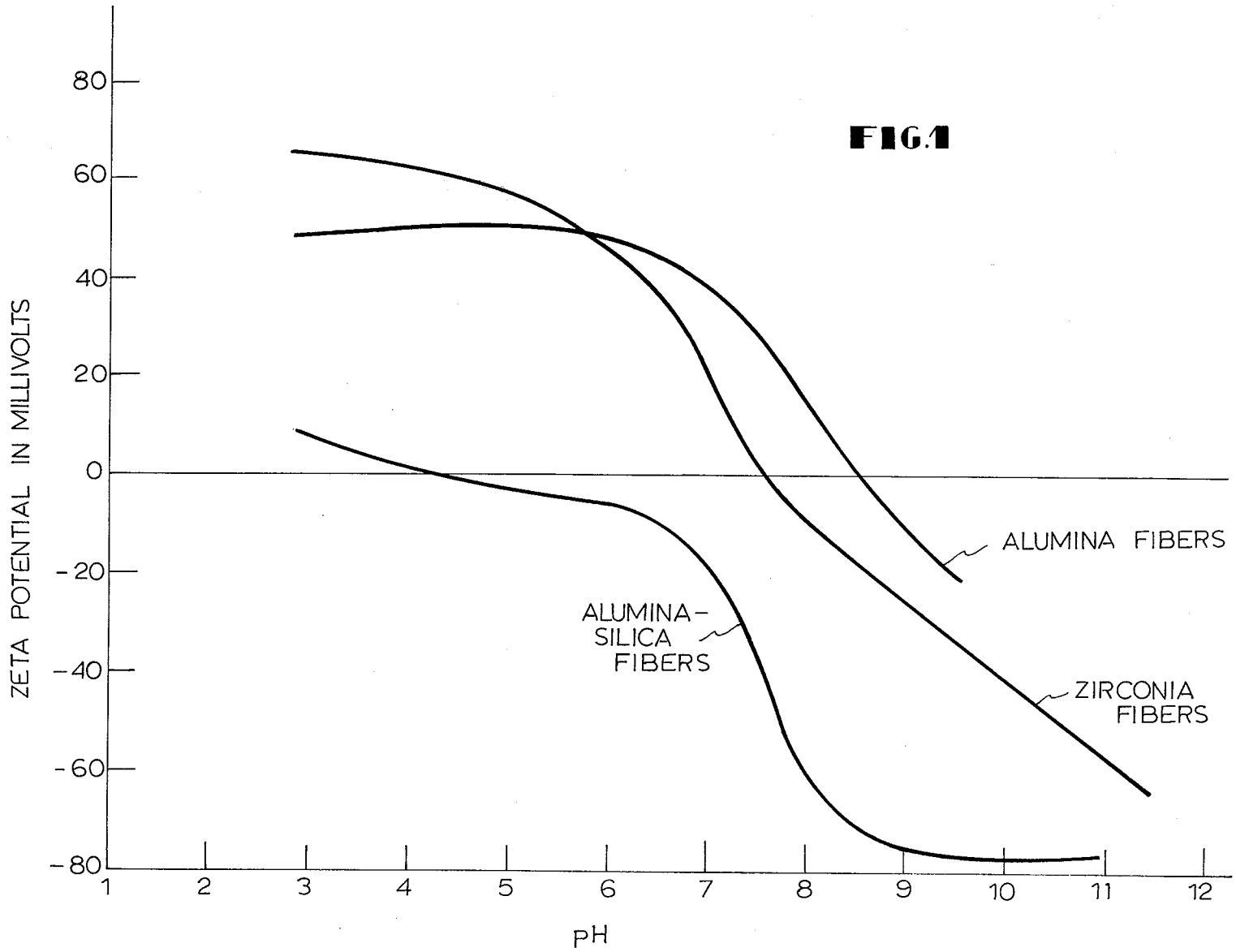
FIG. 1 is a graph showing the zeta potential of fibers suitable for making the filter of the invention.

To increase the size of the particles suspended in the smoke or vapor phase, or to cause their coalescence, a filter made in accordance with the invention comprises synthetic, inorganic, water-insoluble, anhydrous fibers having a positive zeta potential at the pH of tobacco smoke. The positive charge on the fibers attracts the negative charge on the suspended particles, neutralizing them and causing coalescence into clumps of larger size and reducing the number of particle units.

In greater detail, the filter which has furnished outstanding results is made of alumina fibers and which, of course, has the aforementioned properties and characteristics. Such fibers are marketed by ICI America, Inc., Wilmington, Delaware 19899, under the trademark "Saffil". As indicated in FIG. 1, in the pH zone for tobacco smoke, which is approximately 3–6, alumina fibers have a positive zeta potential of between approximately 48–50 millivolts, a strong positive charge. The other significant property of this fiber is that it has a large surface area for absorption, 100–150m²/g, as measured by BET/nitrogen absorption. The mean fiber diameter is 3μ, with about 95% of the fibers within the range of 1–5μ. Other significant properties are fiber density 2.8g/cm$^3$; melting point in excess of 2,000° C.; and tensile strength 150 × 10$^3$ psi.

Although the results were not as superior as furnished with filters made with the high absorption alumina, good results were obtained with a filter made of zirconia fibers. Such fibers are also marketed by ICI America, Inc., under the same "Saffil" trademark. Referring to FIG. 1, zirconia has a positive zeta potential between approximately 50–65. The absorption of zirconia, however, is less than the absorption of alumina, being 5–15m$^2$/g. Fibers are made of the same diameter as alumina fibers. The fiber density for zirconia fibers is 5.6g/cm$^3$; the melting point is in excess of 2,500° C. and the tensile strength is 100 × 10$^3$ psi.

Another synthetic, inorganic, water-insoluble, anhydrous fiber resistant to temperatures of at least approximately 800° C. is an alumina-silica fiber made by Babcock & Wilcox, and sold under the trademark "Kaowool". This fiber is available in an average diameter of 2.8 microns and at an average length of 4 inches. It will withstand a temperature of 2,300° F. and has a tensile strength of 1.9 × 10$^5$psi. The fiber has a specific gravity of 2.56. This fiber consists of approximately 45% $Al_2O_3$, 52% $SiO_2$, 1.3% $Fe_2O_3$, 1.7% $TiO_2$ and traces of MgO, CaO, $Na_2O$, and $B_2O_3$. The positive zeta potential for this fiber is low as compared to the positive zeta potential for the alumina and zirconia fibers; that is, it is only approximately +8 to −6 millivolts in the pH zone for tobacco smoke. This fiber, however, has the advantage of being available in comparatively long lengths, and its positive zeta potential may be enhanced by a positive zeta potential enhancing agent as subsequently described. Also, this fiber is highly suitable for mixture with the high positive zeta potential alumina or zirconia fibers.

The described fibers are made into rod-like form of suitable diameter and density and enveloped in suitable material to furnish filters when cut to predetermined lengths. From the indicated densities, they are very fluffy, and a suitable filter for a cigarette does not require much material or mass.

While good results were obtained with filters made of fibers of alumina, zirconia, alumina-silica, and mixtures thereof, the effectiveness of the filters was improved by further increasing the positive zeta potential of the fibers. This was done by coating the fibers with a secondary source of a positive charge; that is, a positive colloidal metal oxide having more than one positive ion. Preferably, such zeta booster is $Fe(OH)_3$. The advantage of colloidal iron is that it reacts with sulfides such as $H_2S$ and removes it as FeS from the mixture of gases. Other booster materials are ammonium or sodium aluminate, sodium zincates, and zinc oxide. The amount of the booster material or materials may be from a trace to saturation of the fibers. It has been found that even a very small amount of the positive zeta potential booster enhances the action of the positively charged fibers.

Where a positive zeta potential booster is used, the fibers selected for the filter are hydrophilic. If the booster is omitted, it is preferred that the fibers be hydrophobic in character.

Although the invention is preferably used as the filter end of a cigarette, a cartridge may be made in accordance with the invention for mounting in a cigarette holder as known in the art.

Although negatively charged particles predominate, tobacco smoke also contains particles which are positively charged and particles which are neutral. The invention contemplates the treatment of the tobacco so that the carcinogenic tars are removed to an even greater extent by treating the tobacco to be associated with the described filter so that upon burning of the tobacco stronger and additional negative charges are imparted to or induced upon the particulate matter of particles in the smoke.

For the foregoing purposes, the divided tobacco for use in a cigarette or the like has mixed therewith particles of a water-insoluble, hydrophobic, moisture-laden, negative charge-inducing or -imparting substance. Materials of this kind presently known may be generally designated as methylated silicas, and are marketed by Cabot Corporation, Boston, Massachusetts 02110 under the trademark "Silanox", and by Degussa, Inc., Kearny, New Jersey 07032 under the trademark "Aerosil". The product made by Cabot Corporation is a trimethylsilyl group on the surface of the base-fumed silicon dioxide particle after reaction with silane. The reaction changes the surface characteristic of the silicon dioxide from hydrophilic to hydrophobic. The formula is $(CH_3)_3$-Si - O - Si. The product made by Degussa is essentially the same except that there are two (2) methyl groups instead of three (3).

In the presence of the hydrophobic, colloidal, negatively charged methylated silica, water is finely dispersed, so that the fine mist-like particles are surrounded by the colloidal silica particles to prevent them from reuniting to form larger particles. A substance is obtained which has the appearance of a dry powder. Such dry powder is best obtained by using approximately 10% of the colloidal silica and 90% water. Objects immersed in this material are not wetted, and this emulsion of water in hydrophobic, colloidal, methylated silica may be described as "dry water".

Divided tobacco to be made into a cigarette is mixed with the described negatively charged hydrophobic, methylated silica-water system, or "dry water", so that the composition is uniformly dispersed throughout the tobacco. Tobacco thus treated when made into a rod confined by cigarette paper and assembled with a filter made as hereinbefore described furnishes substantially better results than the described filter associated with tobacco which has not been so treated.

The described moisture-laden substance releases moisture upon burning of the tobacco. Tobacco burns at a temperature of approximately 800° C. When drawing upon a cigarette having the tobacco thereof mixed with the described moisture-laden substance, the temperature of the gases or smoke, which is less than the temperature of burning, causes the moisture-laden substance to release the finely dispersed mist-like particles of water, or moisture.

The described filter, and cigarette made with the filter associated with tobacco treated as hereinbefore described act to remove a substantial amount of carcinogenic tars and nicotine; nevertheless, the flavor of the cigarette is not lost because it appears that the flavor-supplying ketones, carbonyls and esters are retained. Cigarettes made with a filter having alumina fibers in which the fibers were coated with a positive zeta potential booster of ferris hydroxide, and with such filter associated with tobacco treated with "dry water" as hereinbefore described upon smoking tests displayed substantially all the discoloration at the juncture of the filter plug with the tobacco; at the mouth end, the filter was practically clear.

All of the compositions, materials and substances referred to are non-toxic and do not present a health hazard to the smoker.

It is believed that the advantages and improved results afforded by the filter of the invention, and by a cigarette comprising tobacco treated in accordance with the invention associated with the described filter will be apparent from the foregoing description of the preferred embodiment of the invention. Various changes and modifications may be made without departing from the spirit and scope of the invention as sought to be defined in the following claims.

I claim:

1. In combination, a body of divided tobacco to be burned, a filter for the tobacco smoke resulting from the burning, the tobacco being mixed with a system of particles of a water-insoluble, hydrophobic, moisture-laden, negative charge-imparting substance which releases moisture upon burning of the tobacco, the filter comprising synthetic, inorganic, water-insoluble, anhydrous fibers having a positive zeta potential at the pH of tobacco smoke.

2. The combination according to claim 1 wherein the substance mixed with the tobacco is a colloidal methylated silica-water system, the particles of methylated silica being dispersed around the water.

3. The combination according to claim 2 wherein the methylated silica and water are present in the amounts, by weight, of approximately 10% and 90%, respectively.

4. The combination according to claim 1 wherein the fibers are selected from the group consisting of alumina, zirconia, alumina-silica, and mixtures thereof.

5. The combination according to claim 4 wherein the substance mixed with the tobacco is a colloidal methylated silica-water system, the particles of methylated silica being dispersed around the water.

6. The combination according to claim 5 wherein the methylated silica and water are present in the amounts, by weight, of approximately 10% and 90%, respectively.

7. The combination according to claim 1 wherein the fibers are hydrophobic.

8. The combination according to claim 7 wherein the substance mixed with the tobacco is a colloidal methylated silica-water system, the particles of methylated silica being dispersed around the water.

9. The combination according to claim 8 wherein the methylated silica and water are present in the amounts, by weight, of approximately 10% and 90%, respectively.

10. The combination according to claim 1 wherein the fibers are hydrophilic.

11. The combination according to claim 10 wherein the substance mixed with the tobacco is colloidal methylated silica-water system, the particles of methylated silica being dispersed around the water.

12. The combination according to claim 11 wherein the methylated silica and water are present in the amounts, by weight, of approximately 10% and 90%, respectively.

13. The combination according to claim 1 wherein the fibers are alumina.

14. The combination according to claim 13 wherein the alumina fibers are hydrophilic and coated with a positive zeta potential enhancing agent.

15. The combination according to claim 14 wherein the positive zeta potential enhancing agent is $Fe(OH)_3$.

16. The combination according to claim 15 wherein the substance mixed with the tobacco is a colloidal methylated silica-water system, the particles of methylated silica being dispersed around the water.

17. The combination according to claim 16 wherein the methylated silica and water are present in the amounts, by weight, of approximately 10% and 90%, respectively.

18. The combination according to claim 14 wherein the substance mixed with the tobacco is a colloidal methylated silica-water system, the particles of methylated silica being dispersed around the water.

19. The combination according to claim 18 wherein the methylated silica and water are present in the amounts, by weight, of approximately 10% and 90%, respectively.

20. The combination according to claim 13 wherein the substance mixed with the tobacco is a colloidal methylated silica-water system, the particles of methylated silica being dispersed around the water.

21. The combination according to claim 20 wherein the methylated silica and water are present in the amounts, by weight, of approximately 10% and 90%, respectively.

22. The combination according to claim 1 wherein the fibers are hydrophilic and coated with a positive zeta potential enhancing agent.

23. The combination according to claim 22 wherein the substance mixed with the tobacco is a colloidal methylated silica-water system, the particles of methylated silica being dispersed around the water.

24. The combination according to claim 23 wherein the methylated silica and water are present in the amounts, by weight, of approximately 10% and 90%, respectively.

* * * * *